United States Patent [19]

Barnes et al.

[11] Patent Number: 5,015,146

[45] Date of Patent: May 14, 1991

[54] VEHICLE DISPLAY LIFT

[75] Inventors: Roger M. Barnes; Stephen L. Comparato, both of Houston, Tex.

[73] Assignee: Loadmaster Manufacturing, Inc., Houston, Tex.

[21] Appl. No.: 421,167

[22] Filed: Oct. 13, 1989

[51] Int. Cl.[5] ..... B66F 7/28

[52] U.S. Cl. ..... 414/639; 414/426; 414/628; 414/662; 187/8.77; 254/89 R

[58] Field of Search ..... 414/426, 427, 662, 668, 414/672, 607, 628, 639; 187/8.41, 8.45, 8.77; 40/607; 254/47, 89 R, 90, 91

[56] References Cited

U.S. PATENT DOCUMENTS

| | | | |
|---|---|---|---|
| 2,135,765 | 11/1938 | Paine | 187/8.45 |
| 2,168,624 | 8/1939 | Musgrave | 187/8.77 X |
| 2,629,507 | 2/1953 | Olson | 414/427 X |
| 2,835,964 | 5/1958 | Yarwood | 414/639 X |
| 2,843,222 | 7/1958 | Villars | 187/8.41 |
| 2,954,626 | 10/1960 | Kies | 40/607 X |
| 2,961,787 | 11/1960 | Kies | 40/607 X |
| 3,111,196 | 11/1963 | Plassman | 187/8.41 |
| 3,415,342 | 12/1968 | Hott | 187/8.77 X |
| 3,420,187 | 1/1969 | Johnson et al. | 187/8.41 |
| 3,709,155 | 1/1973 | Pringle | 414/427 X |
| 4,531,614 | 7/1985 | Naegeli | 187/8.41 X |
| 4,763,761 | 8/1988 | McKinsey et al. | 254/89 R X |
| 4,776,569 | 10/1988 | Nestel-Eichhausen | 254/89 R |
| 4,825,977 | 5/1989 | Isogai | 254/89 R X |

FOREIGN PATENT DOCUMENTS

| | | | |
|---|---|---|---|
| 0231516 | 3/1960 | Australia | 414/639 |
| 3034907 | 4/1982 | Fed. Rep. of Germany | 254/89 R |
| 0528239 | 11/1921 | France | 414/639 |
| 1203038 | 1/1960 | France | 187/8.41 |
| 7537703 | 7/1977 | France | 254/90 |
| 2445294 | 8/1980 | France | 254/89 R |
| 2586666 | 3/1987 | France | 254/89 R |
| 6507837 | 10/1966 | Netherlands | 414/639 |
| 0385898 | 9/1973 | U.S.S.R. | 254/90 |
| 0178114 | 4/1922 | United Kingdom | 414/639 |

*Primary Examiner*—Frank E. Werner
*Assistant Examiner*—John VandenBosche
*Attorney, Agent, or Firm*—Kenneth A. Roddy

[57] ABSTRACT

A vehicle display lift has a vertical mast containing a hoist mechanism which raises and lowers a movable carriage. A cantilever support member connected to the carriage extends outwardly from the mast and has a vehicle support frame on its outer end which receives and supports a vehicle. A low ramp allows the vehicle to be driven onto the support frame at ground level whereupon the hoist mechanism is activated so that the carriage is lifted and guided within the mast causing the vehicle support frame and vehicle to be elevated. The location of the vehicle on the pivotally attached vehicle support frame is such that the center of gravity is forward of the pivot thereby forcing the frame and vehicle to tilt forward as they are elevated until a predetermined tilt angle is achieved at which time the tilting action stops as the elevation continues. The elevation by the hoist mechanism continues until the carriage reaches the top of the vertical mast where activation of a limit switch by the carriage disables the raising circuit of the hoist control. A spring loaded safety latch engages the carriage as it nears the top of the mast as a precaution against failure of the hoist line and is disengaged by the lowering circuit. A sign secured at the upper portion of the vertical mast or on the carriage displays advertising information relative to the vehicle on display.

20 Claims, 5 Drawing Sheets

VEHICLE DISPLAY LIFT

BACKGROUND OF THE INVENTION

1. Field of the Invention

This invention relates generally to vehicle lifts, and more particularly to a vehicle display lift which displays an advertising message, lifts a vehicle from the ground to an elevated display position, tilts the vehicle to an optimum viewing angle, holds the vehicle in the elevated and tilted position for display purposes, and lowers the vehicle back to ground level.

2. Brief Description of the Prior Art

Different configurations of vehicle lifts have been used for many years for the purpose of elevating a vehicle to a convenient height for access beneath for servicing or repairs. These devices although accomplishing the task of elevating a vehicle are not suitable for the purpose of advertising display by elevating a vehicle to a great height, projected it away from the supporting structure, tilting it to an optimum display angle and holding it for extended periods in an outdoor environment with exposure to the elements and substantial wind loading.

There have also been observed various means of supporting a vehicle above ground level for advertising or display purposes. One means is to lift the vehicle by crane or other means to the top of a pole where it is permanently or semi-permanently attached. These means are effective in displaying a vehicle but elevating the vehicle into position is so costly, inconvenient and time consuming that it is seldom used except for permanently mounted vehicles. This is not desirable for new or used car sales where the vehicle model should be changed frequently. Another frequently used means is an elevated ramp structure upon which a vehicle can be driven on or off as desired. This allows relatively convenient changing of vehicles but the small gain in elevation afforded by the ramp does little towards drawing attention to the vehicle.

Although the use of signs in advertising is also well known, heretofore, there has been no use of a sign as an integral part of a vehicle lift which displays the vehicle for advertising purposes, nor have there been signs that elevate with the vehicle.

There are several patents which disclose various vehicle hoist and lift apparatus.

Villars, U.S. Pat. No. 2,843,222 discloses a lifting device having a column formed of two H-shaped beams. An elongate actuating screw and traveling nut mechanism is housed within the beams and driven by a motor mounted on the exterior of the beams to move a slide member on the exterior of the beams vertically. A pair of arms extend outwardly from the slide to receive an automobile to be lifted.

Vilter, U.S. Pat. No. 3,402,828 discloses a boat lift and mooring device which comprises a boat lifting unit supported from parallel spaced vertical columns. The boat lifting unit has a pair of parallel cantilever arms which are engageable under the hull of a boat and connected to the columns by rollers. The lifting unit is moved vertically by a hydraulic ram hoisting mechanism.

Tourmey, U.S. Pat. No. 3,666,053 discloses vehicle lift employing a hydraulic ram mounted on a base plate above which is secured a vehicle lift plate. The lift plate is connected to a top plate at the top of the piston which has a pair of sprockets at each side and a pair of chains passing over it and having one end connected to the upper end of the cylinder and their other end connected to the lift plate. Alternatively, a pair of sheaves and flexible cables may be used. The hoisting mechanism is exposed on the exterior of the ram.

Mason, U.S. Pat. No. 3,734,466 discloses a lift device for rotatably supporting snowmobiles longitudinally between a pair of upright spaced posts for display and repair. The posts are supported on a flat surface by a pair of U-shaped bases. A supporting assembly is slidably mounted on the exterior of each post to be connected to the front and rear of the snowmobile by rotatable hubs. A ratcheting hand operated winch lifts the supporting assemblies with a cable looped over a pulley at the top of each post and its end connected to the supporting member.

Sipia, U.S. Pat. No. 4,594,048 discloses a vehicle lifting device comprising a pair of spaced apart J-shaped bearers. The bearers are provided with mounting plates whereby the front and rear wheel hubs on one side of the vehicle may be secured to the bearers. The vehicle may be rotated sideways through more than 90° for inspection, maintenance, or display.

Van Stokes, et al, U.S. Pat. No. 4,674,938 discloses a vehicle parking system wherein upper and lower platforms are adapted to be moved upward for supporting vehicles above the ground.

The present invention is distinguished over the prior art in general, and these patents in particular by a vehicle display lift having a vertical mast containing a hoist mechanism which raises and lowers a movable carriage. A cantilever support member connected to the carriage extends outwardly from the mast and has a vehicle support frame on its outer end which receives and supports a vehicle. A low ramp allows the vehicle to be driven onto the support frame at ground level whereupon the hoist mechanism is activated so that the carriage is lifted and guided within the mast causing the vehicle support frame and vehicle to be elevated. The location of the vehicle on the pivotally attached vehicle support frame is such that the center of gravity is forward of the pivot thereby forcing the frame and vehicle to tilt forward as they are elevated until a predetermined tilt angle is achieved at which time the tilting action stops as the elevation continues. The elevation by the hoist mechanism continues until the carriage reaches the top of the vertical mast where activation of a limit switch by the carriage disables the raising circuit of the hoist control. A spring loaded safety latch engages the carriage as it nears the top of the mast as a precaution against failure of the hoist line and is disengaged by the lowering circuit. A sign secured at the upper portion of the vertical mast or on the carriage displays advertising information relative to the vehicle on display.

SUMMARY OF THE INVENTION

It is therefore an object of this invention to provide a vehicle display lift which will elevate a vehicle such as a car to a great height for display and attracting attention, support it projected away from the supporting structure so as not to cause visual obstruction and minimize visual distraction, tilt it to an optimum display angle and holding it for extended periods in an outdoor environment with exposure to the elements and substantial wind loading.

It is another object of this invention to provide a safe, convenient, and relatively low cost means of elevating a vehicle for advertising display such that the vehicle on display may be changed as frequently as desired.

Another object of this invention is to provide a vehicle display lift having a display sign on the vehicle lift to enhance its effectiveness in displaying the vehicle and drawing attention to it as well as conveying information relating to the particular vehicle on display.

Another object of this invention is to provide a vehicle display lift which utilizes a skewed relationship between the vehicle and the main supporting structure to allow convenient drive-on access by the vehicle in an installation well suited to most automobile dealership parking lots.

Another object of this invention is to provide a vehicle display lift having a carriage that is guided within the interior of the upright support structure and a slender projecting support arm that frees three sides of the upright support structure so that any decorative or architectural embellishments may be added without interference with the elevating carriage or guide rollers.

Another object of this invention is to provide a vehicle display lift having a carriage that is guided by tracks hidden within the upright support structure so that any damage to the track surface by the highly loaded rollers is not readily apparent and does not detract from the aesthetic appearance.

Another object of this invention is to provide a wireline vehicle lift having a hoisting apparatus that is totally enclosed within the upright support structure and wirelines that are enclosed or partially enclosed.

A further object of this invention is to provide a vehicle display lift having a display sign on the vehicle elevating carriage portion so that the sign message may be changed as the vehicle is changed to reflect the information relating to the particular vehicle on display.

A still further object of this invention is to provide a vehicle display lift which is simple in construction, economical to manufacture, and safe, rugged, and reliable in operation.

Other objects of the invention will become apparent from time to time throughout the specification and claims as hereinafter related.

The above noted objects and other objects of the invention are accomplished by a vehicle display lift having a vertical mast containing a hoist mechanism which raises and lowers a movable carriage. A cantilever support member connected to the carriage extends outwardly from the mast and has a vehicle support frame on its outer end which receives and supports a vehicle. A low ramp allows the vehicle to be driven onto the support frame at ground level whereupon the hoist mechanism is activated so that the carriage is lifted and guided within the mast causing the attached support frame and vehicle to be elevated. The location of the vehicle on the pivotally attached vehicle support frame is such that the center of gravity is forward of the pivot thereby forcing the frame and vehicle to tilt forward as they are elevated until a predetermined tilt angle is achieved at which time the tilting action stops as the elevation continues. The elevation by the hoist mechanism continues until the carriage reaches the top of the vertical mast where activation of a limit switch by the carriage disables the raising circuit of the hoist control. A spring loaded safety latch engages the carriage as it nears the top of the mast as a precaution against failure of the hoist line and is disengaged by the lowering circuit. A sign secured at the upper portion of the vertical mast or on the carriage displays advertising information relative to the vehicle on display.

DESCRIPTION OF THE PREFERRED EMBODIMENT

Figure 1:
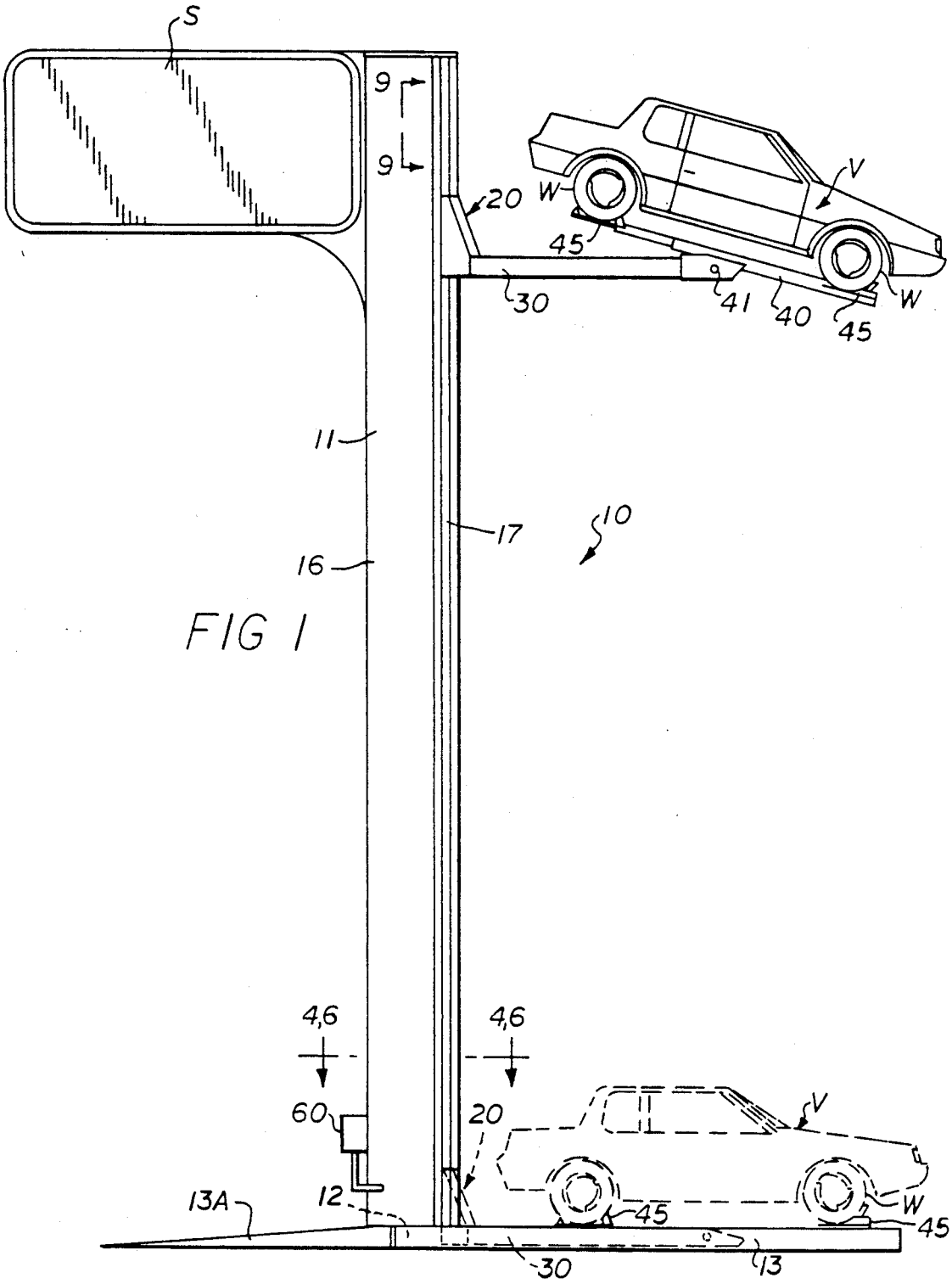
FIG. 1 is a side elevation of a vehicle display lift in accordance with the present invention shown with a vehicle in position prior to lifting and in the fully raised position.
Figure 2:
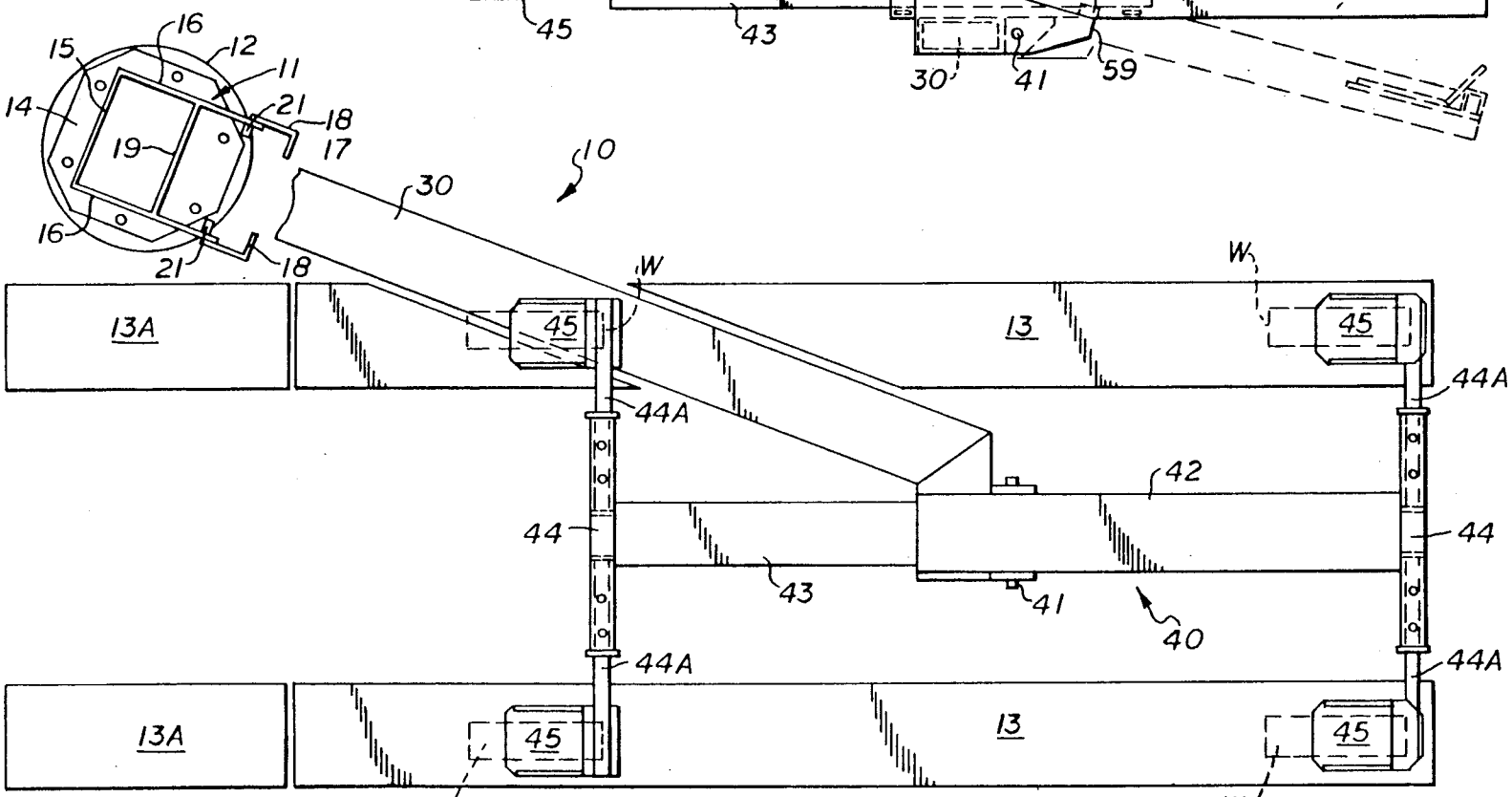
FIG. 2 is a top plan view of the vehicle display lift.
Figure 6:
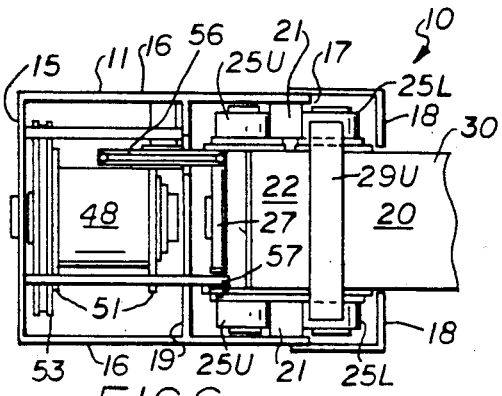
FIG. 6 is a transverse cross section of the lower portion of the mast assembly taken generally along the line 6—6 of FIG. 1 showing the hoist mechanism and guided carriage.
Figure 4:
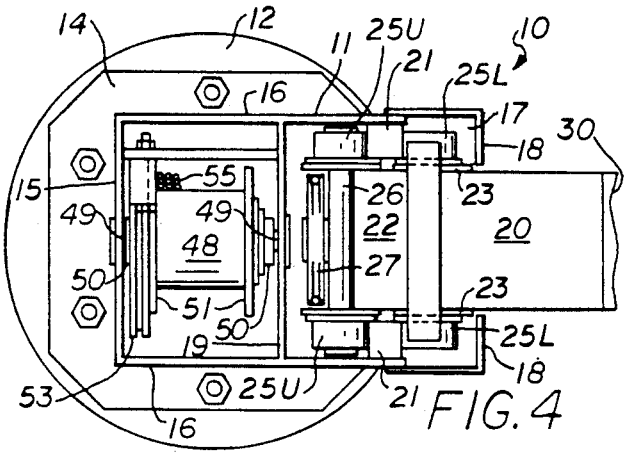
FIG. 4 is a transverse cross section of the lower portion of the mast assembly taken generally along the line 4—4 of FIG. 1 showing the relationship of the guided carriage, the guide tracks, and the wireline drum.
Figure 7:
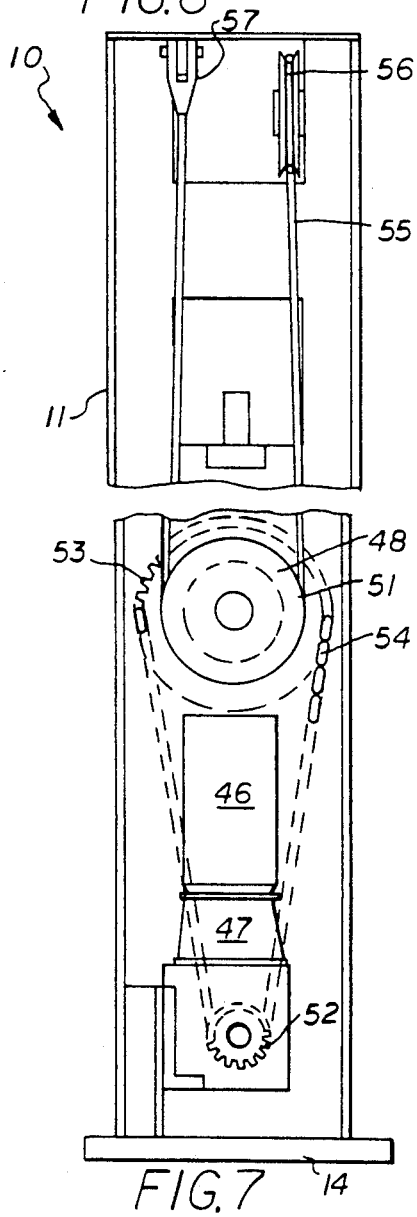
FIG. 7 is a longitudinal cross section of the mast assembly showing the hoist mechanism.

Referring to the drawings by numerals of reference, there is shown in FIGS. 1 and 2, a preferred vehicle display lift 10. A general description of the major components will be first described for an understanding of their relationship followed by a more detailed description of their construction. The vehicle display lift 10 comprises an elongate vertical mast structure 11 which is secured at its lower end to a foundation 12 and supported thereby. The mast structure is capable of supporting the vehicle at a great height above the ground, such as 20–30 feet or more. A guided carriage 20 is movably supported on the vertical mast 11 and is moved vertically thereon by a hoist mechanism housed within the vertical mast 12. A cantilever support member 30 is secured at one end to the guided carriage 20 and has a vehicle support frame 40 pivotally connected at its other end by pivot shaft 41. A pair of laterally parallel spaced ramp members 13 are supported on the ground adjacent the vertical mast 11 and each has a removable inclined ramp section 13A at one end for driving a vehicle V onto the ramps 16.

A sign S which may be illuminated is secured at the top of the mast structure 11 for displaying an advertising message or the like. Optionally, the sign S may be secured to the guided carriage 20 and raised and lowered along with the carriage as described hereinafter.

A suitable motor control panel 60 is located on the lower portion of the mast member for controlling the operation of the hoist mechanism.

As best seen in FIG. 2, the vertical mast structure 11 is positioned adjacent one end of the ramps 13 and the cantilever support member 30 extends angularly outward from the mast structure 11 to the center of the parallel ramp members 3 where it is pivotally attached to the vehicle support frame 40. One of the ramp members 13 is diagonally segmented to allow the cantilever support member 30 to pass therethrough in its lowermost position.

The vehicle support frame 40 is a generally H-shaped configuration comprising a front main member 42 of square or rectangular structural tubing attached to the cantilever support member 30 by pivot shaft 41. A rear main member 43 of square or rectangular structural tubing has one end slidably received within one end of the front main member 42 in telescoping relation. Cross members 44 of square or rectangular tubing are secured transversely across the outer ends of the front main member 42 and rear main member 43. Lateral extension members 44A of square or rectangular tubing have one end slidably received within each end of the cross members 44 in telescoping relation. Wheel support pads or plates 45 are secured at the outer ends of the lateral extension members 44A. The vehicle support frame 40 is longitudinally and laterally adjustable to position the wheel support pads or plates 45 to receive the wheels W of various vehicles. A pair of pivot stop pads 58 are secured on opposite sides of the front main member 42.

Figure 3:
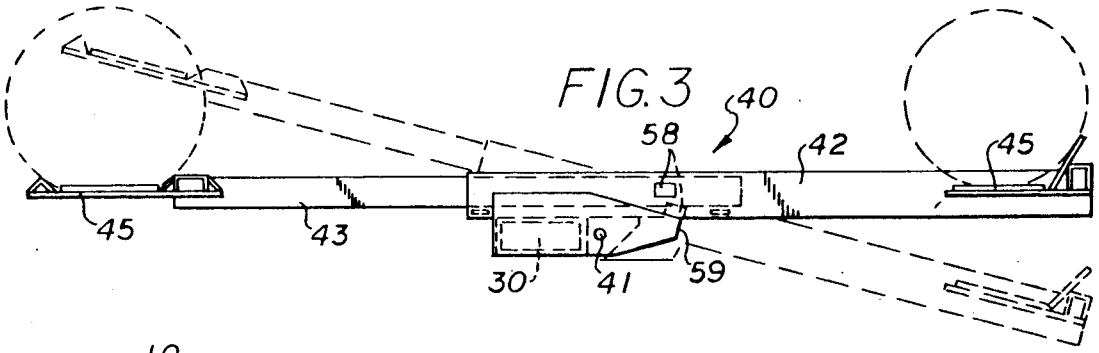
FIG. 3 is a side elevation of the vehicle support frame shown in the horizontal position and the tilted position is shown in dotted line.

Referring additionally to FIG. 3, as the carriage 20 is raised, attached cantilever support member 30 rises with it. The center of gravity of vehicle V is located forward of pivot shaft 41 which causes the support frame 40 with the vehicle V to tilt forward about the pivot shaft 41 as the elevation continues. The tilting action stops when the pivot stop pads 58 contact the stationary front portion of the cantilever support member 30.

Referring again to FIG. 3 in the initial lowermost position, the vehicle support frame 40 rests on the top of the ramps 13 with the spacing of the wheel support pads 25 set to receive the wheels of the vehicle to be displayed. The vehicle V to be displayed is driven up the inclined portions 13A of the ramps 13 and is stopped with its front and rear wheels W on top of the wheel support pads 45.

Having thus briefly described the major components of the vehicle display lift, a more detailed description of the components will be undertaken with reference to FIGS. 3–7.

The elongate vertical mast structure 11 is a hollow structural member having a base plate 14, a longitudinal rear wall 5, opposed longitudinal side walls 16, and one longitudinal open side 17. The base plate 14 is conventionally bolted to a concrete pier foundation 12. A pair of opposed longitudinal trim plates 18 are secured to the side walls 16 and extend partially across the open side 17. One or more longitudinal web members 19 extend substantially the length of the mast structure 11 between the side walls 16. A pair of rails or tracks 21 are secured on the interior of the side walls 16 in opposed relation near the open side 17 and extend substantially the length of the mast structure 11.

The guided carriage 20 comprises an elongate rectangular carriage body 22 which has a mounting plate 23 secured on each side at its lower end. The mounting plate 23 is secured to the cantilever support member 30 with bolts 24. An upper and lower pair of flanged rollers 25U and 25L, respectively, are rotatably mounted one on each side at the upper and lower portions of the carriage body 22 on projecting portions of roller shafts 26 which are removably affixed to the carriage body 22. The upper and lower pairs of flanged rollers 25U and 25L are spaced horizontally and vertically such that they will receive the longitudinal track or rail 21 therebetween and be supported thereon in a vertically movable relation. A carriage sheave 27 is rotatably mounted on the inward side wall of the carriage body 22 facing the web member 19 of the upright mast 11 by shaft 28 removably affixed to the carriage body 22.

The guided carriage 20 is installed within the mast 11 between side walls 16 with upper flanged rollers 25U in contact with the interior face of roller tracks 21 and the lower flanged rollers 25L in contact with the exterior face of roller tracks 21. An upper retainer plate 29U is bolted to the top of carriage body 22 and extends outwardly from the carriage body 22 and laterally across the exterior face of roller tracks 21. Lower retainer plate 29L is bolted to the bottom of carriage body 22 and extends inwardly from the carriage body 22 and laterally across the interior face of roller tracks 21.

The hoist mechanism housed within the mast 11 comprises an electric or hydraulic motor 46 mounted on and operatively coupled to a speed reducer 47 which is mounted inside the bottom portion of upright mast 11. A wireline drum 48 is rotatably mounted on a drum shaft 49 supported and retained at each end by mountings within the upright mast structure 11 and extending through bearings 50 bolted to each drum flange 51 of the wireline drum 48. An output sprocket 52 attached to the output shaft of speed reducer 47 is coupled to the drum sprocket 53 by a drive chain 54.

Figure 8:
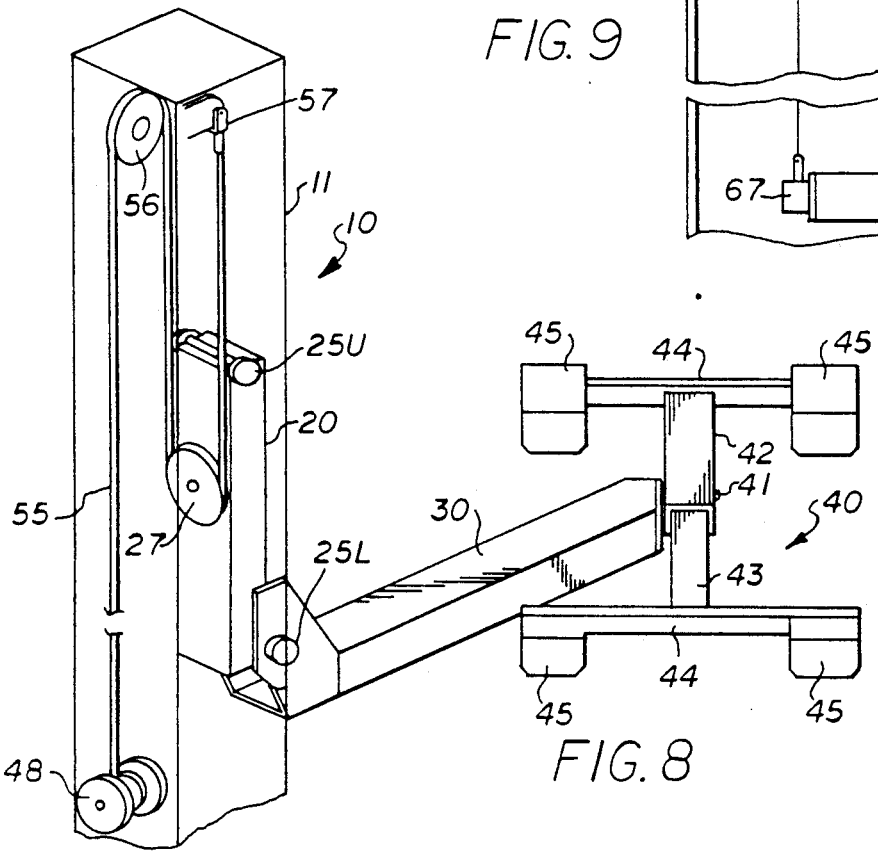
FIG. 8 is a schematic illustration of the hoisting mechanism, guided carriage, and vehicle support members.

Referring additionally to FIG. 8, a wireline 55 wraps around the drum 48 and then runs in a substantially vertical direction to an upper sheave 56 rotatably mounted near the top of upright mast 11. Wireline 55 wraps over upper sheave 56 approximately 180 degrees then extends downward to the carriage sheave 27 mounted on the carriage body 22 of guided carriage 20. Wireline 55 then wraps under the carriage sheave 27 approximately 180 degrees then extends upward to the top of the upright mast 11 where it is attached to a wireline anchor 57.

Figure 5:
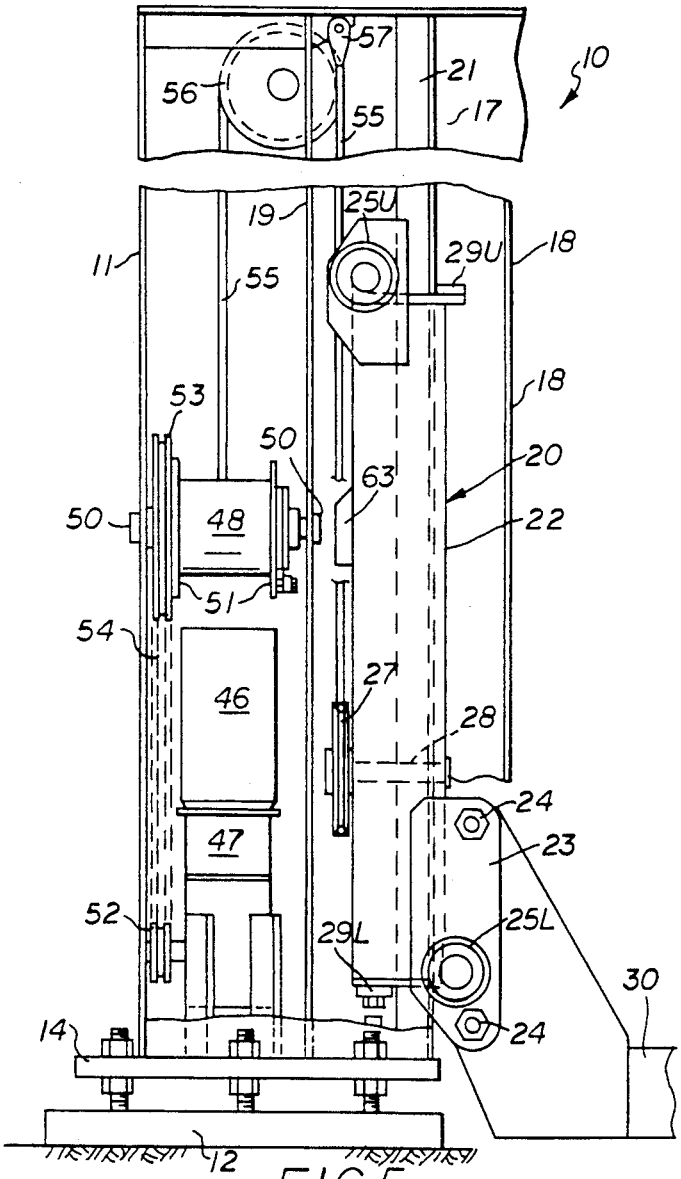
FIG. 5 is a longitudinal cross section of the mast assembly showing the guided carriage and hoist mechanism.
Figure 10:
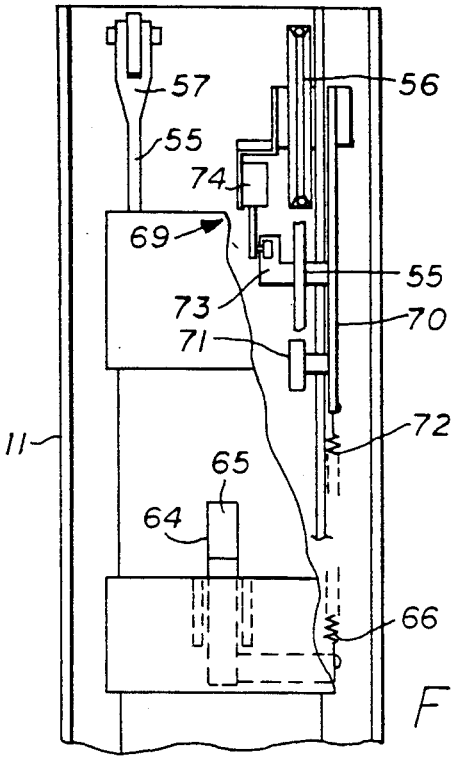
FIGS. 9 and 10 are longitudinal cross section views of the upper portion of the mast assembly in slightly larger scale showing the limit switch and safety latch mechanism.
Figure 9:
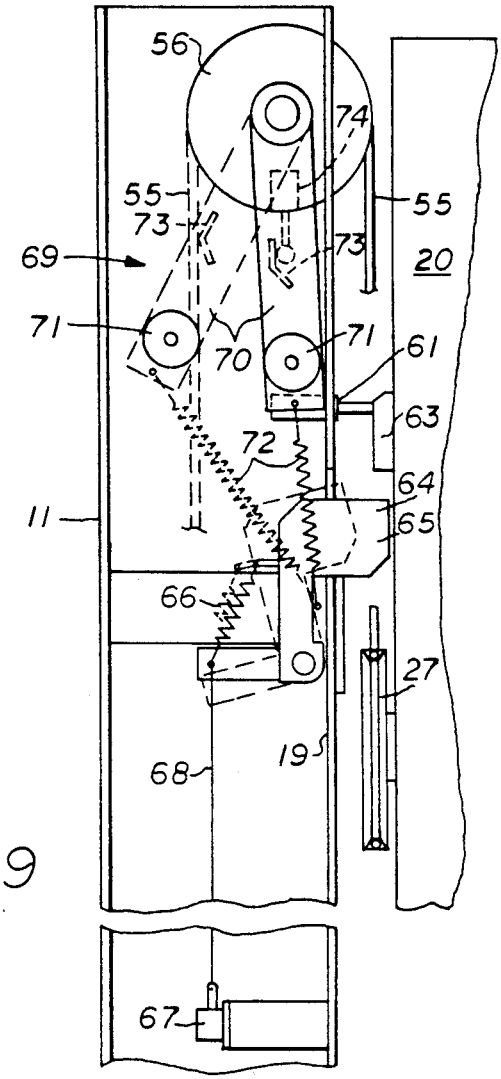

As seen in FIGS. 5, and 9, a rectangular actuator strap 63 is provided on the inward facing surface of the carriage member 20 and has a beveled top end. When the carriage 20 reaches its uppermost position, the actuator strap 63 contacts a limit switch 61 mounted on the web member 19 near the upper end of the mast 11. A spring loaded safety latch 64 is pivotally mounted within the mast 11 and has a front portion 65 which extends through the web 19 and terminates closely adjacent the inward surface of the carriage 20. Spring 66 connected between the latch 64 and the mast 11 maintains the latch in the forward spring biased position. The bottom surface of the latch 64 is safety latch 64 will pivot upwardly and rearwardly allowing the actuator strap 63 to pass the safety latch on the upward movement of the carriage but will not allow the carriage to move back down. When the carriage 20 reaches its uppermost position, the actuator strap 63 contacts the limit switch 6 1 to disable the raising circuit and the carriage stops.

A solenoid 67 mounted on the web 19 and connected to the safety latch 64 by a cable 68 is activated by the lowering circuit to retract the safety latch and allows the carriage to be lowered.

A slack detector mechanism 69 is mounted on the upper sheave 56. The slack detector comprises an idler sheave arm 70 pivotally connected at one side of the upper sheave 56 and has an idler sheave 71 rotatably mounted thereon which is maintained in contact with the wireline 55 by a spring 72. An outwardly extending actuator tab 73 is secured to the idler sheave arm 70. A limit switch 74 is mounted on the other side of the upper sheave 56. When there is tension in the wireline 55, the actuator tab 73 is held away from the limit switch 74. When the wireline 55 is slack, the spring 72 will pivot the arm 70 into a generally vertical position and the tab 73 will contact the limit switch 74 to disable the down o lowering circuit.

Figure 11:
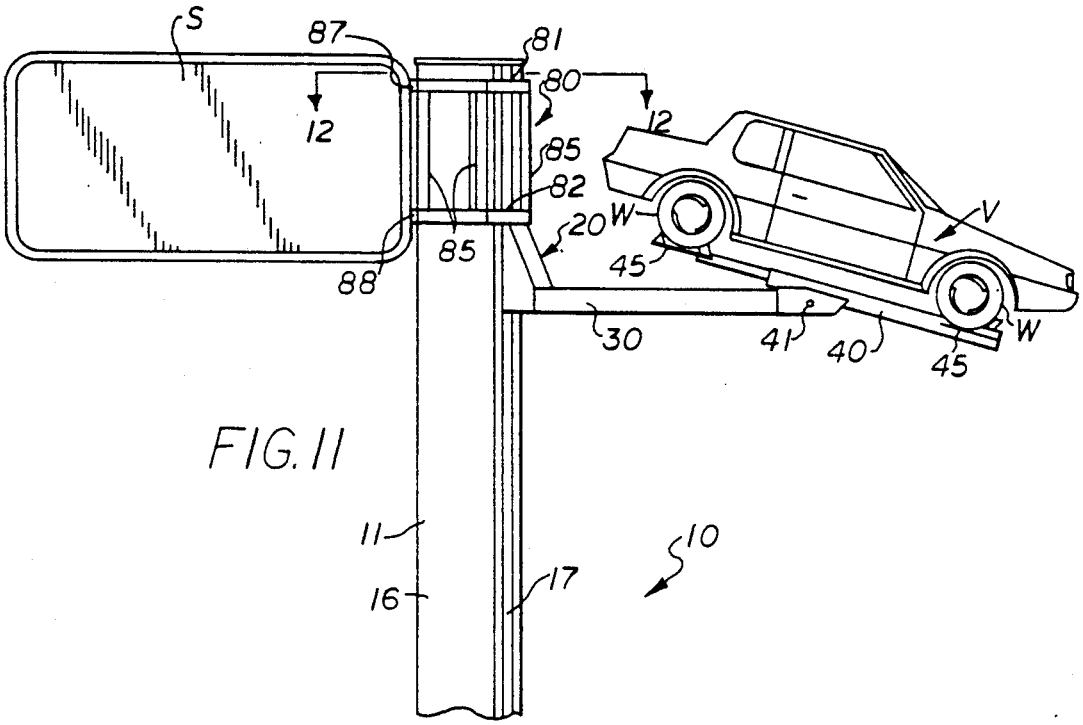
FIG. 11 is a partial side elevation of a vehicle display lift having a sign which is raised and lowered with the carriage.
Figure 12:
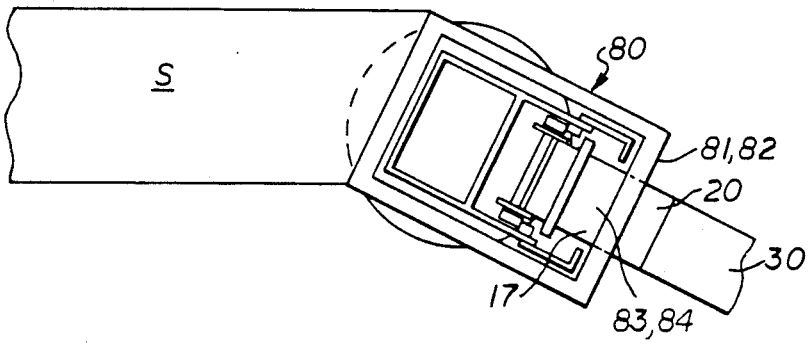
FIG. 12 is a transverse cross section taken along line 12—12 of the mast showing the sign support structure.

FIGS. 11 and 12 illustrate somewhat schematically, an alternate embodiment of the vehicle lift 10 wherein the sign S is secured to the guided carriage 20 by a support frame 80 and raised and lowered along with the carriage. The support frame 80 comprises rectangular upper and lower horizontal frame members 81 and 82 formed of square tubing or channel. The upper and lower frame members 81 and 82 are secured to the carriage 20 in vertical spaced relation by tubing or channel members 83 and 84 which extend through the open side 17 and are welded or otherwise secured between the carriage 20 and the upper and lower frame members 81 and 82. Vertical channel members 85 are welded between the upper and lower frame members near each corner.

The support frame 80 is configured to surround the mast structure 11 and the sign S is secured to the support frame 80 by conventional means. Additional structural bracing members may be welded between the sign and the support frame members for additional strength and support.

Thus, the sign S is mounted on a frame 80 attached to the carriage 20 to move up and down as the carriage is raised or lowered. The embodiment of FIGS. 11 and 12 allow the display sign message to be easily changed as the vehicle is changed to reflect the information relating to the particular vehicle on display.

OPERATION

Vehicle V is driven onto vehicle support frame 40 resting on ramps 13. The operator then activates the up circuit of motor control 60 causing motor 46 to rotate the input shaft of speed reducer 47 and the output sprocket 52 of the speed reducer transmits power to the drum sprocket 53 via drive chain 54. As the drum sprocket 53 rotates, it causes the wireline drum 48 to turn and the wireline 55 to be further wound onto the drum.

As the wireline 55 is wound onto wireline drum 48, a hoisting action is initiated in which the carriage 20 is elevated within the upright mast 11 by the pull of the wireline 55 on carriage sheave 27. The roller tracks 21 guide the flanged rollers 25U and 25L maintaining the carriage 20 level and defining its vertical path.

Referring to FIG. 3, the elevation of carriage 20 causes the attached cantilever support member 30 to rise with it. The center of gravity of vehicle V being located forward of pivot shaft 41 causes the support frame 40 with the vehicle V to tilt forward about the pivot shaft 41 as the elevation continues. The tilting action stops when the pivot stop members 58 contact the stationary front portion 59 of the cantilever support member 30.

The elevation continues until the carriage 20 contacts the limit switch 61 which opens the up circuit of the motor control 60. As the carriage 20 is being raised, the safety latch 64 will pivot upwardly and rearwardly allowing the actuator strap 63 to pass the safety latch on the upward movement of the carriage but will not allow the carriage to move back down. When the carriage 20 reaches its uppermost position, the actuator strap 63 contacts the limit switch 61 to disable the raising circuit and the carriage stops.

To lower the vehicle V, the above procedure is reversed by actuating the down circuit of the motor control 60. The solenoid 67 mounted on the web 19 and connected to the safety latch 64 by a cable 68 is activated by the lowering circuit to retract the safety latch and allows the carriage to be lowered.

When the carriage 20 reaches its lowermost position, the vehicle and support frame 40 rests on the ramps 13. As the load is relieved from the hoist line, the slack in the hoist line is detected by the slack detector limit switch 74 and the down circuit is disabled. The vehicle may then be driven off of the vehicle support frame and ramps.

Thus, the vehicle display lift 10 performs the functions of displaying an advertising message, elevating a vehicle from the ground to its display position, tilting the vehicle to an optimum viewing angle, holding the vehicle in the elevated and tilted position for display purposes, and lowering the vehicle back to ground level.

An alternate embodiment of the vehicle display lift performs the functions of displaying an advertising message, elevating a vehicle and sign from the ground to their respective display positions, tilting the vehicle to an optimum viewing angle, holding the sign and the vehicle in the elevated position for display purposes, and lowering the vehicle and sign back to ground level.

While this invention has been described fully and completely with special emphasis upon a preferred embodiment, it should be understood that within the scope of the appended claims the invention may be practiced otherwise than as specifically described herein.

What is claimed is:

1. A vehicle display lift for supporting and displaying a vehicle at a substantial height above the ground comprising;

an elongate vertical mast member supported at its bottom end on the ground, carriage means movably mounted on said vertical mast member for vertical movement thereon between a lowermost position and an uppermost position, hoist means on said mast member coupled to said carriage means for vertically moving said carriage means on said mast, motor means connected to said hoist means including control means operatively connected to a source of power for controlling the operation of said hoist means, cantilever arm means secured at one end to said carriage means to move vertically therewith and extending horizontally outward therefrom, and vehicle support means pivotally secured to the outer end of said cantilever arms means at a pivot point intermediate the center of gravity of said vehicle support means and said carriage means to tilt by gravity a predetermined distance relative thereto as said carriage means is moved vertically and adapted to receive a vehicle thereon when said carriage is in its lowermost position and said vehicle support means is in a substantially horizontal orientation and support the vehicle thereon at a predetermined angle relative to said cantilever arm to display the supported vehicle at a substantial distance above the ground when said carriage means is in its uppermost position.

2. A vehicle display lift according to claim 1 in which said elongate vertical mast member is securely anchored at its bottom end to the ground.

3. A vehicle display lift according to claim 1 in which said hoist means is disposed within said mast member.

4. A vehicle display lift according to claim 1 in which said vehicle support means is pivotally secured to the outer end of said cantilever arm means and is adapted to be tilted relative to said cantilever arm to display the supported vehicle at an angle at a substantial distance above the ground.

5. A vehicle display lift according to claim 1 including a sign secured at the upper portion of said vertical mast for displaying information relative to the vehicle on display.

6. A vehicle display lift according to claim 1 including a sign secured to said carriage means and movable therewith for displaying information relative to the vehicle on display, whereby the sign information may be changed as the vehicle to be displayed is changed when said vehicle support means is in its lowermost position.

7. A vehicle display lift according to claim 1 including ramp means supported on the ground and operatively positioned to receive said vehicle support means, whereby the vehicle to be displayed may be driven onto said ramp means and received on said vehicle support member in its lowermost position prior to being lifted and may be driven off said ramp means after being displayed.

8. A vehicle display lift according to claim 1 in which said hoist means comprises a motorized wireline hoist including a drum member within said mast member and a wireline wound on said drum and coupled to said carriage means for vertically moving said carriage means on said mast.

9. A vehicle display lift according to claim 1 in which said vertical mast member has two longitudinal side walls, a longitudinal rear wall, and a partially open longitudinal front wall to substantially enclose said carriage means and said hoist means within said mast member, and said cantilever arm means extending horizontally outward from said partially open longitudinal front wall.

10. A vehicle display lift according to claim 1 in which said cantilever arm means comprises an elongate structural beam secured at one end to said carriage means and having a pivot mechanism at its outer end, and said vehicle support means comprises a generally H-shaped frame of structural tubing having a central longitudinal member pivotally connected to the outer end of said cantilever arm pivot mechanism and a pair of transverse cross members secured one at each end of the central longitudinal member extending laterally to each side thereof, and wheel support plates secured at the laterally extended ends of said cross members for receiving the wheels of a vehicle to be displayed.

11. A vehicle display lift according to claim 10 in which said central longitudinal member is formed of two sections of structural tubing on slidably received telescopically within the other for adjustably spacing said cross members relative to one another to fit the wheel base of various wheeled vehicles.

12. A vehicle display lift according to claim 10 in which each said cross member is formed of a section of structural tubing having a lateral extension member slidably received in each outer end in telescoping relation, said wheel support plates are secured to the outer ends of said extension members, and said extension members being laterally adjustable to fit the lateral spacing of the wheels of various vehicles.

13. A vehicle display lift according to claim 1 in which said central longitudinal member is formed of two sections of structural tubing one slidably received telescopically within the other for adjustably spacing said cross members relative to one another to fit the wheel base of various wheeled vehicles, each said cross member is formed of a section of structural tubing having a lateral extension member slidably received in each outer end in telescoping relation, said wheel support plates are secured to the outer ends of said extension members, and said extension members being laterally adjustable to fit the lateral spacing of the wheels of various vehicles.

14. A vehicle display lift according to claim 10 in which said pivot mechanism includes a stop member for stopping the pivotal movement of said vehicle support member relative to said cantilever arm member at a predetermined angle, whereby when said carriage means is raised vertically, the vehicle will be tilted forward and downward about the pivot mechanism allowing the vehicle to be displayed at a predetermined angle.

15. A vehicle display lift according to claim 1 including a pair of parallel elongate track members secured in laterally opposed relation within said vertical mast member, and said carriage means is slidably received and supported on said tracks for vertical movement within said vertical mast member.

16. A vehicle display lift according to claim 15 in which said vertical mast member has two longitudinal side walls, a longitudinal rear wall, and a partially open longitudinal front wall to substantially enclose said carriage means and said hoist means within said mast member, said cantilever arm means extends horizontally outward from said partially open longitudinal front wall, and said pair of parallel elongate track members are secured in laterally opposed relation one on each side wall interior adjacent said partially open longitudinal front wall, and said carriage means slidably received and supported on said tracks for vertical movement within said vertical mast member adjacent said partially open longitudinal front wall.

17. A vehicle display lift according to claim 16 in which said carriage means is a vertical rectangular member having roller members rotatably engaged on said track members for vertical movement within said vertical mast member adjacent said partially open longitudinal front wall.

18. A vehicle display lift according to claim 17 in which said hoist means comprises a motorized wireline hoist including a drum member within said mast member and a wireline wound on said drum, said carriage means has a carriage sheave rotatably mounted thereon, and said wireline is operatively connected to said carriage sheave for supporting said carriage and moving it vertically on said tracks within said vertical mast member.

19. A vehicle display lift according to claim 18 including a mast sheave rotatably mounted at the upper end of said mast member, and said wireline is operatively connected to said mast sheave and to said carriage sheave for supporting said carriage and moving it vertically on said tracks within said vertical mast member.

20. A vehicle display lift according to claim 1 including safety latch means within said vertical mast member and movable into engagement against said carriage means to prevent downward movement thereof upon failure of said hoist means.

* * * * *